US011765792B2

(12) United States Patent
Daniel et al.

(10) Patent No.: US 11,765,792 B2
(45) Date of Patent: Sep. 19, 2023

(54) PTC HEATING MODULE AND A METHOD FOR PRODUCING THE PTC HEATING MODULE

(71) Applicant: Mahle International GmbH, Stuttgart (DE)

(72) Inventors: Alexander Daniel, Stuttgart (DE); Michael Kohl, Bietigheim-Bissingen (DE); Jonas Caspar Schwenzer, Karlsruhe (DE); Wolfgang Seewald, Tamm (DE); Falk Viehrig, Stuttgart (DE)

(73) Assignee: Mahle International GmbH

( * ) Notice: Subject to any disclaimer, the term of this patent is extended or adjusted under 35 U.S.C. 154(b) by 718 days.

(21) Appl. No.: 16/669,497

(22) Filed: Oct. 30, 2019

(65) Prior Publication Data

US 2020/0137837 A1 Apr. 30, 2020

(30) Foreign Application Priority Data

Oct. 31, 2018 (DE) ..... 102018218667.7

(51) Int. Cl.
*H05B 1/02* (2006.01)
*H05B 3/22* (2006.01)

(52) U.S. Cl.
CPC ..... *H05B 1/0297* (2013.01); *H05B 3/22* (2013.01); *H05B 2203/017* (2013.01); *H05B 2203/02* (2013.01); *H05B 2203/021* (2013.01)

(58) Field of Classification Search
CPC .. H05B 3/22; H05B 2203/023; H05B 1/0297; H05B 2203/02; H05B 2203/021; H05B 2203/017
See application file for complete search history.

(56) References Cited

U.S. PATENT DOCUMENTS 5,633,978 A * 5/1997 Hofsass ..... H05B 3/80 219/544
6,720,536 B2 4/2004 Bohlender
2017/0303340 A1* 10/2017 O'Sullivan ..... H05B 3/24

FOREIGN PATENT DOCUMENTS

DE 102016107032 A1 10/2017
EP 1318694 A1 6/2003
(Continued)

OTHER PUBLICATIONS

English abstract for EP-2211589.
English abstract for EP-2397788.
English abstract for EP-2602567.

*Primary Examiner* — Dana Ross
*Assistant Examiner* — Kuangyue Chen
(74) *Attorney, Agent, or Firm* — Fishman Stewart PLLC

(57) ABSTRACT

The disclosure relates to a PTC heating module for heating a fluid and a method for producing such a PTC heating module. The PTC heating module includes a plurality of PTC thermistors having main surfaces disposed opposite to one another and spaced apart relative to one another in a thickness direction. The PTC thermistors are arranged between two contact plates next to one another transversely to the thickness direction and spaced apart relative to one another. The main surfaces of the PTC thermistors are electrically contacted with a contact surface of the two contact plates. At least one dielectric function element is arranged between the two contact plates and laterally sealingly engages about the respective PTC thermistors to at least partially fill a hollow space between the two contact plates and facilitate enlarging a creepage distance between the two contact plates within the hollow space.

20 Claims, 4 Drawing Sheets

(56) References Cited

FOREIGN PATENT DOCUMENTS

| | | | |
|---|---|---|---|
| EP | 2211589 | A1 | 7/2010 |
| EP | 2397788 | A1 | 12/2011 |
| EP | 2602567 | B1 | 5/2016 |

* cited by examiner

PTC HEATING MODULE AND A METHOD FOR PRODUCING THE PTC HEATING MODULE

CROSS-REFERENCE TO RELATED APPLICATION

This application claims priority to German Patent Application No. DE 10 2018 218 667.7 filed on Oct. 31, 2018, the contents of which are hereby incorporated by reference in its entirety.

TECHNICAL FIELD

The invention relates to a PTC heating module for heating a fluid and to a method for producing the PTC heating module. The invention also relates to a method for producing the PTC heating module.

BACKGROUND

A PTC heater (PTC: positive temperature coefficient) usually comprises multiple PTC heating modules and is provided for heating a fluid. In the PTC heating module, multiple PTC thermistors consisting of a PTC thermistor material installed between two contact plates, so that when a voltage is applied, the PTC thermistors generate heat and because of this can heat the fluid—air or coolant. Such PTC heaters are known for example from DE 10 2016 107 032 A1. PTC heaters can be employed for example in electric vehicles for heating interior air. In this application, the PTC heating modules are not to be operated with a vehicle electrical system voltage of 12 V, but with a battery voltage of 400 V or in the future even 800 V. This requires a strong electrical insulation in order to secure on the one hand the function of the PTC heating module and avoid short circuits and on the other hand ensure complete safeguarding of the occupants. For this purpose, fluid-side surfaces of all constituents of the PTC heating module supplied with an electric potential have to have a minimum distance to other conductive components. These are referred to as air gaps and creeping distances. The air gap provides the shortest distance of two conductive components through air and the creepage distance a distance between two conductive components along an insulating surface. The air gaps and creepage distances depend on the maximum test and operating voltage. The test voltage can be up to 6 kV, so that a creepage distance has to be up to 4 mm and significantly exceeds a layer thickness of a conventional PTC thermistors. In addition, an insulation additionally requires layers which can prevent the discharge of the heat generated in the PTC thermistors towards the outside.

SUMMARY

The object of the invention therefore is to state an improved or at least alternative embodiment for a PTC heating module of the generic type, with which the described disadvantages are overcome. The object of the invention also is to provide a method for producing the PTC heating module.

According to the invention, this object is solved through the subject of the independent claim(s). Advantageous embodiments are subject of the dependent claims.

A PTC heating module for heating a fluid comprises multiple PTC thermistors with two main surfaces, wherein the main surfaces of the respective PTC thermistor are, located opposite one another and spaced apart in the thickness direction relative to one another. In addition, the PTC heating module comprises two contact plates with a contact surface each, between which the respective PTC thermistors are arranged next to one another transversely to the thickness direction and spaced apart from one another. The main surfaces of the respective PTC thermistor are electrically contacted with the contact surfaces of the two contact plates. According to the invention, the PTC heating module comprises at least one dielectric function element, which is arranged between the two contact plates and, sealing laterally, engages about the respective PTC thermistors. By way of this, a hollow space between the two contact plates in the thickness direction is filled out at least partially with the function element and a creepage distance between the two contact plates is enlarged within the hollow space.

The function element partly fills out the hollow space of the PTC heating module in the thickness direction, as a result of which a physical separation of the two potential-carrying contact plates is realised. Because of this, a creepage distance between the two contact plates is increased and the creepage currents excluded. Here, the function element, laterally sealingly, engages about the PTC thermistors in the PTC heating module so that no creepage currents can flow through a lateral air gap between the function element and the respective PTC thermistor. By way of this, the electric contact between the two contact plates in the PTC heating module is exclusively realised by the PTC thermistors. By way of such a comprehensive electrical insulation within the PTC heating module, the voltage in the PTC heating module and because of this its output can be increased without adjusting the thermistor dimensions in the thickness direction.

The PTC thermistors can be electrically contacted with the contact plates directly or indirectly. Thus, the respective PTC thermistors can be electrically contacted with the respective contact plate for example via an electrically conductive layer—for example made of silver. Alternatively, an electrically conductive contact base can be arranged between the respective PTC thermistor and at least one of the two contact plates. A support face of the contact base lying against the PTC thermistor is smaller than the main surface of the PTC thermistor and the PTC thermistor therefore projects from the contact base transversely to the thickness direction. Here, the contact base can be electrically contacted with the respective contact plate and the respective PTC thermistor indirectly or directly. Accordingly, an electrically conductive layer—for example consisting of silver—each can be arranged for example between the contact base and the contact plate and/or the respective PTC thermistor. The electrically conductive layer then does not project at the contact base or only slightly, so as not to shorten the creepage distances between the electrically conductive layer and the contact plates.

The PTC heating module can comprise a housing in which the contact plates are fixed with the PTC thermistors. At the end faces located opposite the contact surfaces, the contact plates can be heat-transferringly connected to a wall of the housing in order to be able to emit the heat generated in the PTC thermistors to the housing. The housing can be formed of a heat-conductive material—for example metal—and then emit the heat to a fluid—for example air—circulating about the housing. In order to intensify the heat emission a rip structure through which a fluid can flow can be fixed or integrally formed on the housing outside. In order to be able to electrically insulate the contact plates towards the outside and towards the housing of the PTC heating module, a dielectric basic coating can be positively fixed to the end face of the respective contact plate located opposite the contact surface. Alternatively to the dielectric basic coating, the respective PTC heating module can comprise a dielectric insulation cladding. The dielectric insulation cladding then dads the two contact plates on four sides, insulating these electrically towards the outside. The basic coating and the insulation cladding can be heat-conductive in order to be able to conduct the heat generated in the respective PTC thermistors from the respective contact plate to the outside to the housing.

With an advantageous further development of the PTC heating module it is provided that the dielectric function element is an insulation plate. The insulation plate consists preferentially of ceramic. The insulation plate can be for example clamped between the two contact plates so that the hollow space between the contact plates round about the respective PTC thermistor is completely filled out. Alternatively, the insulation plate can only partly fill out the hollow space in the thickness direction and lie for example against one of the contact surfaces or be fixed to one of these. In addition it can be provided that the insulation plate, transversely to the thickness direction, projects out of the hollow space towards the outside. By way of this, an air gap between the two contact plates is enlarged in an edge region of the contact plates.

With an advantageous alternative further development of the PTC heating module it is provided that the at least one dielectric function element is a dielectric coating which is firmly bonded to the contact surface of at least one of the contact plates round about the respective PTC thermistors. The dielectric coating then covers the contact surface of the respective contact plate completely round about the respective PTC thermistors which are electrically contacted with the contact plates. Here, the coating sealingly adjoins the respective thermistors laterally, so that no creep currents can flow through a lateral air gap between the dielectric coating and the respective PTC heating module. Here, the dielectric coating can be applied to the respective contact surface of the contact plate by injecting or by over-moulding or by spraying-on a dielectric material or by anodizing with a dielectric material or by dipping into a dielectric material or by gluing on a film consisting of a dielectric material or by a further suitable method. It is obvious that the application method should be selected dependent on the desired embodiment of the dielectric coating. The dielectric material is preferentially plastic.

Advantageously it can be provided that the dielectric coating is fixed on the contact surfaces of the two contact plates round about the PTC thermistors. The hollow space between the two contact plates can be partly filled out in the thickness direction. The dielectric coating then comprises two dielectric non-contiguous material part layers, of which each is fixed to the contact surface of the respective contact plate. In the PTC heating module, the two dielectric material part layers are separated from one another in the thickness direction by an air gap. The respective dielectric material part layer laterally sealingly engages about the respective PTC thermistors on the contact surface.

Alternatively, the dielectric coating can be fixed on the contact surfaces of the two contact plates round about the PTC thermistors, wherein the hollow space between the two contact plates is completely filled out in the thickness direction. Then, the dielectric coating is formed by a single dielectric material layer which lies on the contact surface of the one contact plate and on the contact surface of the other contact plate in a firmly bonded manner. When producing the PTC heating module, the dielectric material layer can be produced from two material part layers on the respective contact surfaces which are subsequently joined or pressed to form the single material layer.

Alternatively it can be provided that the dielectric coating on the contact surfaces of the two contact plates is fixed round about the PTC thermistors. Here, the hollow space between the two contact plates can be partly filled out in the thickness direction and the respective PTC thermistors be clad by the dielectric coating transversely to the thickness direction. Then, the dielectric coating is formed by a single contiguous material layer which completely separates the PTC thermistors in the hollow space transversely to the thickness direction and the contact surfaces round about the respective PTC thermistors from air. Then, the hollow space remains partly filled out in the thickness direction so that between the contact plates or within the contiguous material layer an air gap extending transversely to the thickness direction remains.

When between the respective PTC thermistor and the respective contact plate a contact base as described above is arranged, a thickness of the as least one contact base defined in the thickness direction can be smaller than a layer thickness of the dielectric coating defined in the thickness direction on the respective contact plate. Because of this, the respective contact base is completely clad by the dielectric coating on the respective contact plate transversely to the thickness direction, as a result of which creepage currents between the contact base and the contact plate located opposite are prevented.

Advantageously it can be provided that the dielectric coating on the respective contact plate is fixed outside the respective contact surface at least in regions and laterally dads the respective contact plate. By way of this, an air gap between the two contact plates is enlarged in an edge region of the contact plates. Alternatively or additionally, the dielectric coating can project from the hollow space towards the outside transversely to the thickness direction so that in an edge region of the contact plates an air gap between the two contact plates is enlarged. Here, the respective contact plate can also remain uncoated laterally.

With a further development of the PTC heating module with the dielectric coating it is provided that the dielectric coating completely dads the respective contact plate round about the respective PTC thermistors and electrically insulates the two contact plates towards the outside. By way of this, the respective contact plate in the PTC heating module can also be electrically insulated relative to a housing of the PTC heating module. The dielectric coating can replace or complement the dielectric basic coating described above or the dielectric insulation cladding in the PTC heating module described above.

In summary, the voltage in the PTC heating module and thus its output can be increased by the dielectric function element without adjusting the thermistor dimensions in the thickness direction.

The invention also relates to a method for producing the PTC heating module described above. There, the respective PTC thermistors are joined simultaneously with the two contact plates or first with the one contact plate and then with the other contact plate and because of this indirectly or directly electrically contacted with the respective contact plates. Furthermore, prior to the joining or after the joining of the respective PTC thermistors with the respective contact plate, the at least one dielectric function element in the form of a dielectric coating is applied to the contact surface of at least one of the contact plates.

In order to electrically insulate the contact plates towards the outside, a dielectric basic coating can be applied to an end face of the respective contact plate located opposite the contact surface. Alternatively, a dielectric insulation cladding can be applied to the two contact plates, cladding the same on four sides. The dielectric coating on the respective contact plate can, alternatively or additionally, be applied in regions outside the respective contact surface and the respective contact plate be laterally or completely clad. When the contact plate is laterally clad by the dielectric coating, an air gap in an edge region of the contact plates can thereby be enlarged. When the contact plate is completely clad by the dielectric coating round about the respective PTC thermistors, the dielectric basic coating described above and the insulation cladding described above can thereby be completely replaced or complemented.

Advantageously it can be provided that the dielectric coating after the joining of the respective PTC thermistors with the two contact plates is produced by injecting or by over-moulding or by spraying-in a dielectric material or by anodizing with a dielectric material or by dipping into a dielectric material. Alternatively, the dielectric coating can be applied by over-moulding or by spraying-on a dielectric material or by anodizing with a dielectric material or by dipping into a dielectric material or by gluing a film consisting of a dielectric material round about the PTC thermistors after the joining of the respective PTC thermistors with the respective contact plate. Alternatively, the dielectric coating can be applied round about place holder elements by over-moulding or by spraying-on a dielectric material or by anodizing with a dielectric material or by dipping into a dielectric material or by gluing on a film consisting of a dielectric material prior to the joining of the respective PTC thermistors with the respective contact plate. The place holder elements are removed thereafter and the respective PTC thermistors are subsequently joined with the respective contact plate in places kept by the place holder elements.

By way of the alternatives described above, multiple possibilities for carrying out the method are obtained. Accordingly, the PTC thermistors for example can first be fixed to one of the contact plates. Thereafter, the dielectric coating can be effected on the one contact plate round about the PTC thermistors and on the other contact plate round about the place holder elements. Once the place holder elements have been removed, the PTC thermistors can be joined with the other contact plate in kept places and the PTC heating module thereby produced. Alternatively, the dielectric coating can be applied to both contact plates round about the place holder elements. Once the place holder elements have been removed, the PTC thermistors can be joined with the contact plates. This can take place simultaneously with both contact plates or first with the one contact plate and then with the other contact plate. Alternatively, the two contact plates can be joined with the PTC thermistors and subsequently the dielectric coating applied. Basically, carrying out the method can be matched to the desired configuration of the dielectric coating.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

It shows, in each case schematically

DETAILED DESCRIPTION

Figure 1:
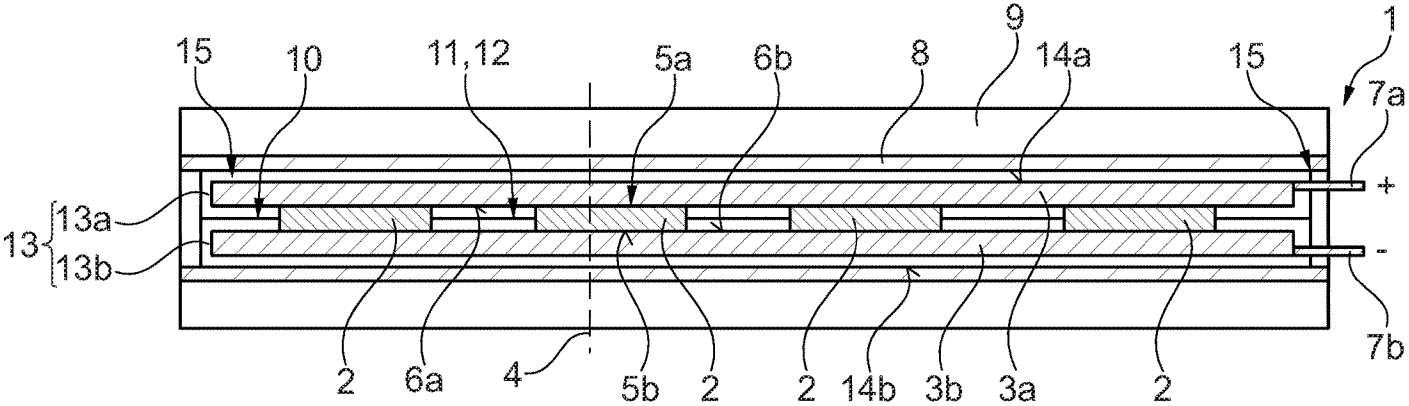
FIGS. 1 to 12 illustrate sectional views each of a deviatingly configured PTC heating module according to the invention.

FIG. 1 shows a sectional view of a PTC heating module 1 according to the invention for heating a fluid. The PTC heating module 1 comprises multiple PTC thermistors 2 consisting of a PTC thermistor material and two contact plates 3*a* and 3*b*, with which the PTC thermistors 2 are stacked in the thickness direction 4. The respective PTC thermistors 2 each comprise two main surfaces 5*a* and 5*b* which located opposite one another and in thickness direction 4 are spaced apart relative to one another. The main surfaces 5*a* and 5*b* are directly or indirectly in electrical contact with a contact surface 6*a* and 6*b* of the respective contact plate 3*a* and 3*b* each so that the respective PTC thermistor 2 is electrically contacted with the contact plates 3*a* and 3*b*. The contact plates 3*a* and 3*b* can be connected to an external voltage source, for the purpose of which on the contact plates 3*a* and 3*b* a contact element 7*a* and 7*b* each is formed or fixed. In this exemplary embodiment, the PTC heating module 1 comprises a housing 8 which provides cladding for the two contact plates 3*a* and 3*b* and the PTC thermistors 2 arranged in between. On the housing 8, a rib structure 9—only schematically indicated here—is fixed, through which a fluid such as air can flow. The respective PTC thermistors 2 are arranged transversely relative to the thickness direction 4 next to one another and spaced apart relative to one another, so that between the two contact plates 3*a* and 3*b* a hollow space 10 is formed.

Furthermore, the PTC heating module 1 comprises a function element 11 which in this exemplary embodiment is a dielectric coating 12. The dielectric coating 12 is fixed on the contact surfaces 6*a* and 6*b* of the contact plates 3*a* and 3*b* round about the PTC thermistors 2 in a firmly bonded manner and completely fills out the hollow space 10. The coating 12 sealingly adjoins the thermistors 2 laterally, so that no creepage currents can flow through a lateral air gap between the dielectric coating 12 and the PTC thermistors 2. A creepage distance between the two contact plates 3*a* and 3*b* is enlarged within the hollow space 10. In this exemplary embodiment, the dielectric coating 12 comprises two dielectric material part layers 13*a* and 13*b*, of which each is fixed on the contact surface 6*a* and 6*b* of the respective contact plate 3*a* and 3*b*. In the PTC heating module 1, the two dielectric material part layers 13*a* and 13*b* are arranged in thickness direction 4 on one another and form a contiguous material layer 13, so that the hollow space 10 is completely filled out in the thickness direction 4.

The dielectric coating 12 or the material layers 13*a* and 13*b* completely clad in this exemplary embodiment the respective contact plates 3*a* and 3*b* round about the PTC thermistors 2, so that the contact plates 3*a* and 3*b* are covered by the dielectric coating 12 or by the material part layers 13*a* and 13*b* also laterally and on their end faces 14*a* and 14*b*. Because of this, an air gap in an edge region 15 of the respective contact plates 3*a* and 3*b* is reduced. Furthermore, the dielectric coating 12 or the material part layers 13*a* and 13*b* are applied onto the end faces 14*a* and 14*b* and electrically insulate the two contact plates 3*a* and 3*b* from the housing 8 of the PTC heating module 1. Here, the dielectric coating 12 can be heat-conductive so that the heat generated in the PTC thermistors 2 can be emitted to the housing 8 and further via the rib structure 9 to the fluid flowing through the rib structure 9 via the contact plates 3*a* and 3*b* and the dielectric coating 12.

In the following, deviating configurations of the PTC heating module 1 are explained. For the sake of clarity, the housing 8 and the rib structure 9 are not shown in FIG. 2 to FIG. 12. However, these can be embodied in the same way as in the PTC heating module 1 in FIG. 1. Furthermore, in some embodiments, no insulation is shown on the end faces 14*a* and 14*b*. It goes without saying that this insulation—in the case that it is not otherwise provided—can be realised by a basic coating or an insulation cladding.

Figure 2:
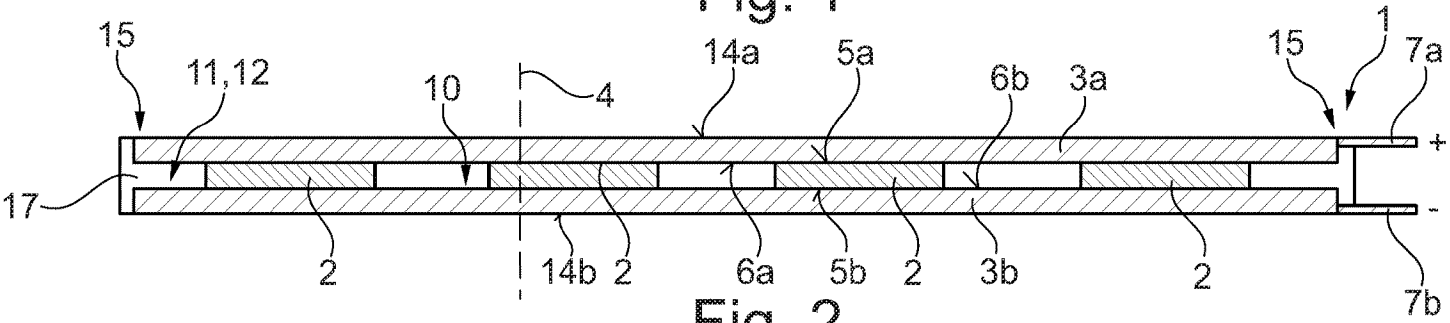

FIG. 2 shows a sectional view of the alternatively configured PTC heating module 1 with the function element 11 in the form of the dielectric coating 12. In the PTC heating module 1 shown here, the dielectric coating 12 is formed by a single material layer 17, which can be produced for example by injecting a dielectric material—preferentially plastic—into the hollow space 10. In this exemplary embodiment, the dielectric coating 12 or the material layer 12 engages about the respective contact plates 3*a* and 3*b* laterally, so that an air gap in the edge region 15 of the contact plates 3*a* and 3*b* is enlarged. Here, no dielectric coating 12 is applied onto the end faces 14*a* and 14*b*.

Figure 3:
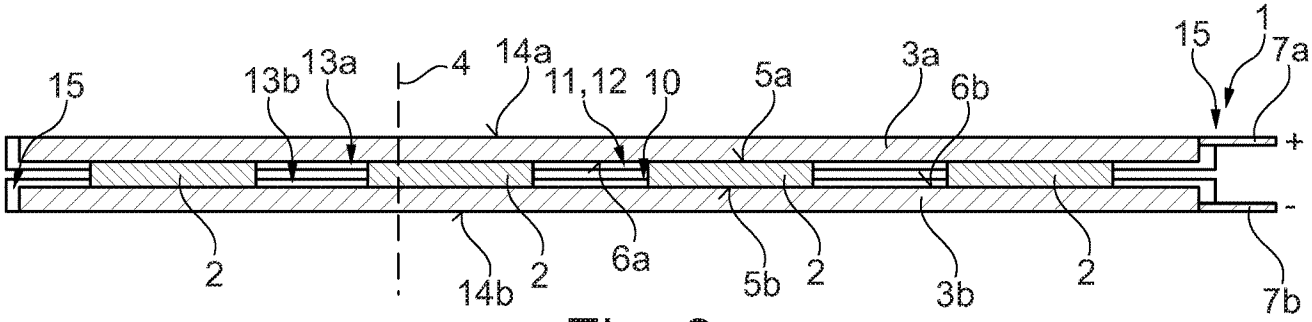

FIG. 3 shows a sectional view of the alternatively configured PTC heating module with the function element 11 in the form of the dielectric coating 12. In this exemplary embodiment, the dielectric coating 12 comprises the material part layers 13*a* and 13*b*, which in contrast with the embodiment in FIG. 1 are not contiguous. Because of this, the hollow space 10 is filled out only partially in the thickness direction 4. The material part layers 13*a* and 13*b* engage about the contact plates 3*a* and 3*b* laterally, so that an air gap 22 in the edge region 15 is enlarged. Here, no dielectric coating 12 is applied onto the end faces 14*a* and 14*b*.

Figure 4:
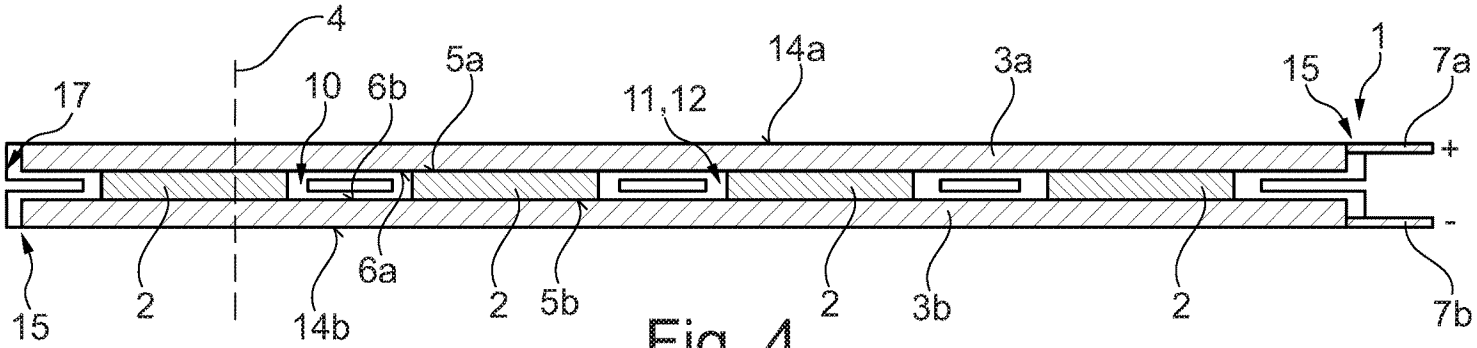

FIG. 4 shows a sectional view of the alternatively configured PTC heating module 1 with the function element 11 in the form of the dielectric coating 12. In this exemplary embodiment, the dielectric coating 12 is formed by the contiguous material layer 17 which completely separates the PTC thermistors 2 in the hollow space 10 transversely to the thickness direction 4 and the contact surfaces 6*a* and 6*b* round about the respective PTC thermistors 2 from air. However, the hollow space 10 is partly filled out in the thickness direction 4 so that between the contact plates 3*a* and 3*b* within the contiguous material layer 17 an air gap extending transversely to the thickness direction 4 remains. Here, too, the dielectric coating 12 or the material layer 17 laterally encloses the contact plates 3*a* and 3*b* in order to enlarge an air gap 22 in the edge region 15 of the contact plates 3*a* and 3*b*. Here, no dielectric coating 12 is applied onto the end faces 14*a* and 14*b*.

Figure 5:
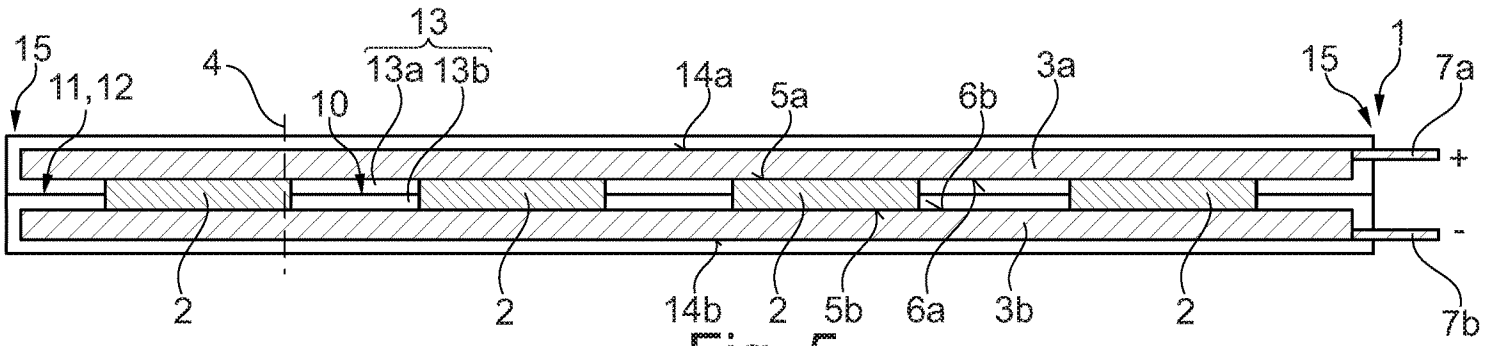

FIG. 5 shows a sectional view of the PTC heating module 1 from FIG. 1 without the housing 8 and without the rib structure 9.

Figure 6:
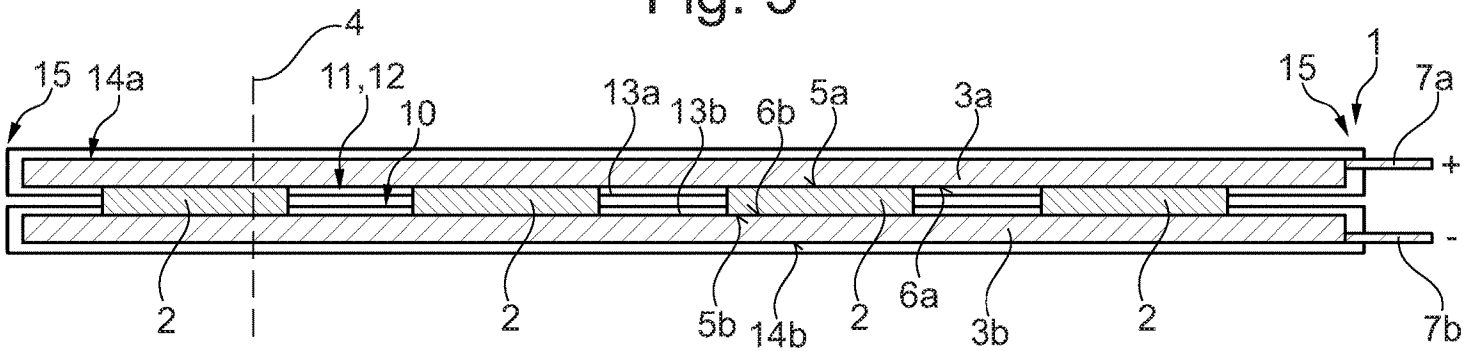

FIG. 6 shows a sectional view of the alternatively configured PTC heating module 1 with the function element 11 in the form of the dielectric coating 12. In this exemplary embodiment, the dielectric coating 12, deviating from FIG. 3, is also applied onto the end faces 14*a* and 14*b* of the contact plates 3*a* and 3*b*. Here, a basic coating and an insulation cladding can be omitted. Otherwise, the PTC heating module 1, in this case, corresponds to the PTC heating module in FIG. 3.

Figure 7:
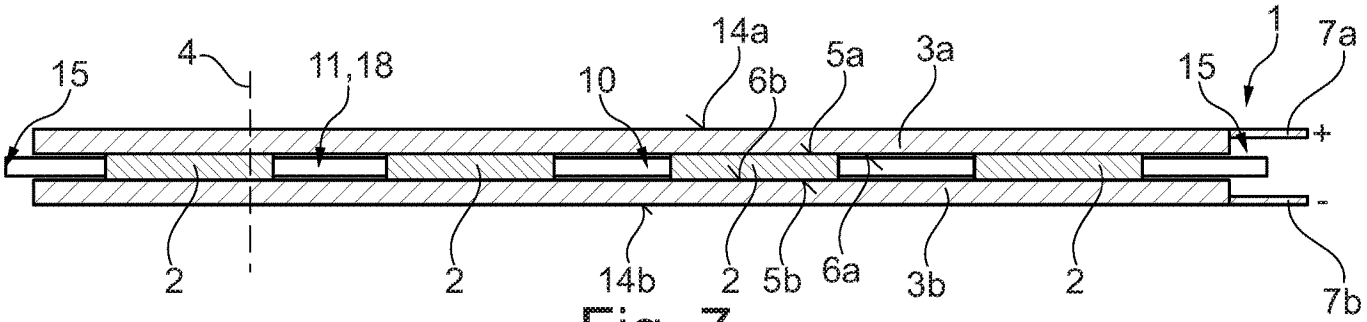

FIG. 7 shows a sectional view of the alternatively configured PTC heating module 1 with the function element 11 in the form of an insulation plate 18. The insulation plate 18 is preferentially produced from ceramic and is arranged between the two contact plates 3*a* and 3*b*, so that the hollow space 10 between the contact plates 3*a* and 3*b* round about the respective PTC thermistors 2 is completely filled out. Furthermore, the insulation plate 18 projects transversely to the thickness direction 4 out of the hollow space 10 towards the outside, so that in the edge region 15 of the contact plates 3*a* and 3*b* an air gap is enlarged.

Figure 8:
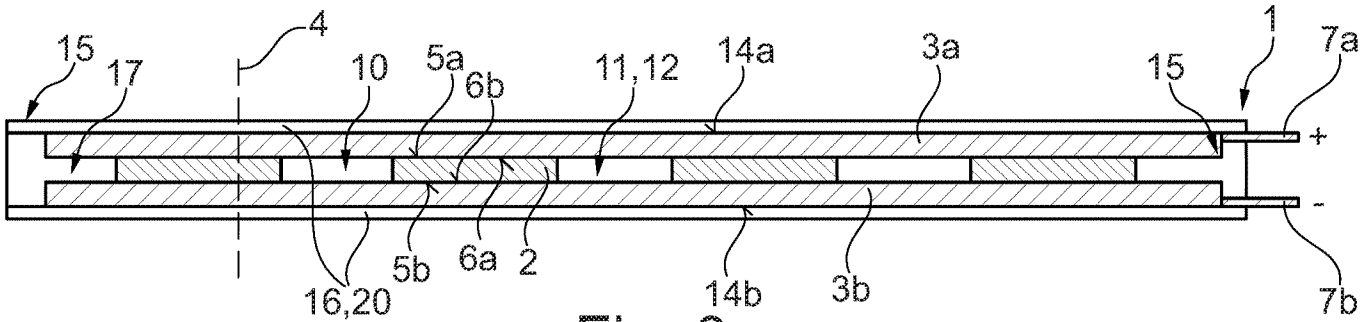

FIG. 8 shows a sectional view of the alternatively configured PTC heating module 1 with the function element 11 in the form of the dielectric coating 12. In this exemplary embodiment, a basic coating 16 or an insulation cladding 20 is applied onto the end faces 14*a* and 14*b* of the contact plates 3*a* and 3*b*, which are not distinguishable in the sectional view shown here. Otherwise, the PTC heating module 1, in this case, corresponds to the PTC heating module in FIG. 2.

Figure 9:
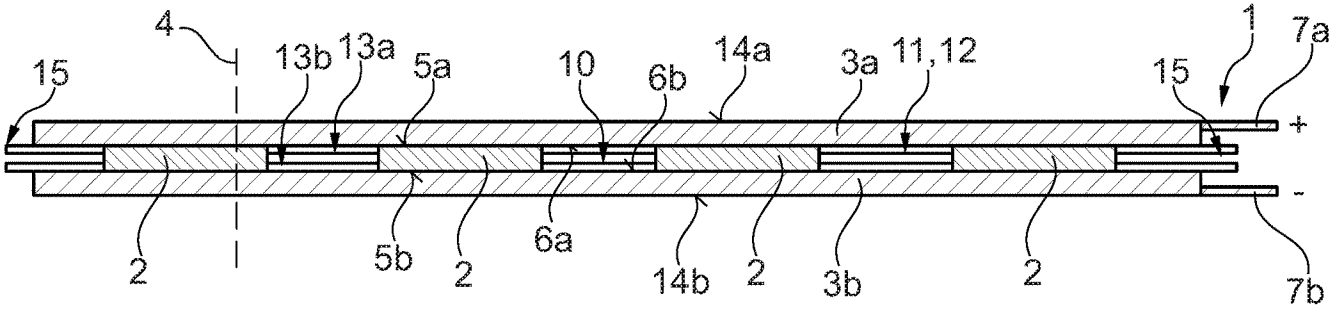

FIG. 9 shows a sectional view of the alternatively configured PTC heating module 1 with the function element 11 in the form of the dielectric coating 12. Deviating from FIG. 3, the dielectric coating 12 in this case does not engage about the contact plates 3*a* and 3*b*. Instead, the dielectric coating 12 projects out of the hollow space 12 transversely to the thickness direction 4 so that an air gap in the edge region 15 of the contact plates 3*a* and 3*b* is enlarged. Otherwise, the PTC heating module 1, in this case, corresponds to the PTC heating module in FIG. 3.

Figure 10:
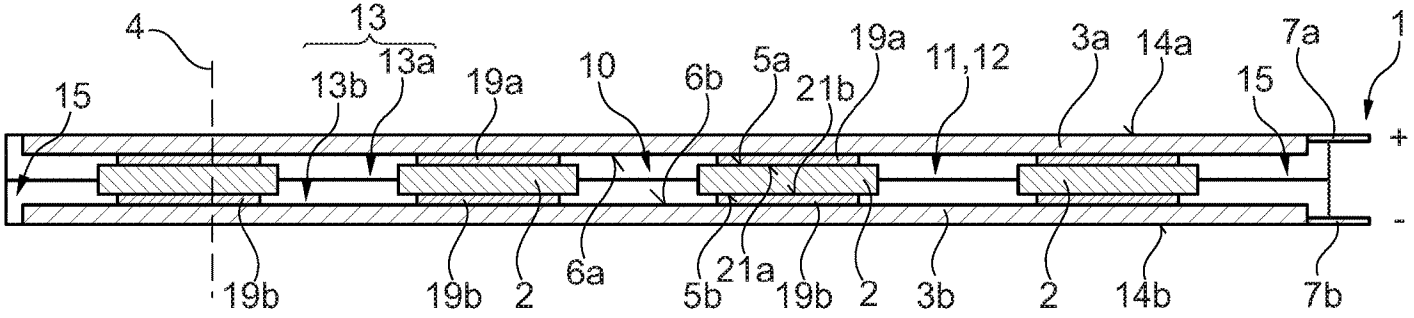

FIG. 10 shows a sectional view of the alternatively configured PTC heating module 1 with the function element 11 in the form of the dielectric coating 12. Deviating from the embodiment in FIG. 2, the respective PTC thermistor 2, in this case, is electrically contacted with the respective contact plate 3*a* and 3*b* in each case via a contact base 19*a* and 19*b*. A support face 21*a* and 21*b* of the respective contact base 19*a* and 19*b* is smaller than the respective main surface 5*a* and 5*b* of the PTC thermistor 2, so that the respective PTC thermistor 2 projects on the respective contact base 19*a* and 19*b* transversely to the thickness direction 4. Furthermore, the thickness of the respective contact base 19*a* and 19*b* is smaller in the thickness direction 4 than the layer thickness of the material part layers 13*a* and 13*b*, so that the contact base 19*a* and 19*b* is completely clad laterally by the dielectric coating 12.

Figure 11:
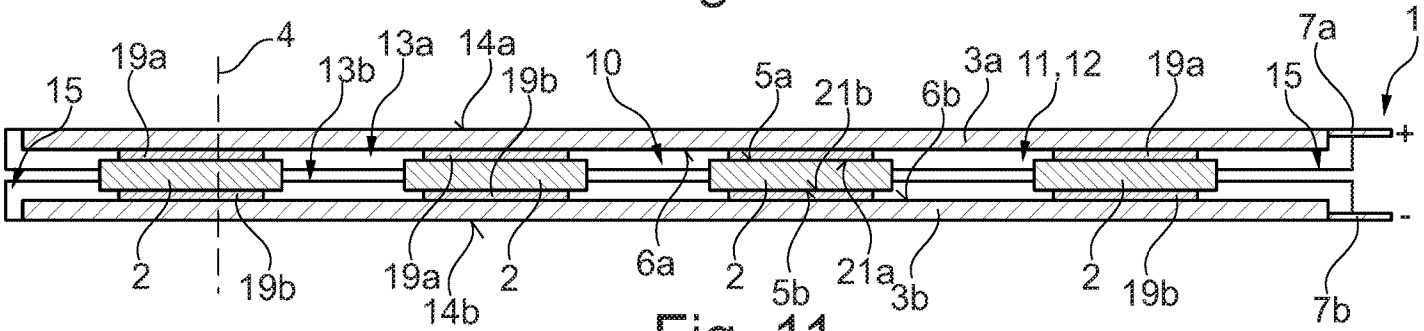

FIG. 11 shows a sectional view of the alternatively configured PTC heating module 1 with the function element 11 in the form of the dielectric coating 12. Deviating from the embodiment in FIG. 3, the respective PTC thermistor 2 in this case is electrically contacted with the respective contact plate 3*a* and 3*b* via the contact base 19*a* and 19*b*. Here, the dielectric coating 12 is formed by the two material part layers 13*a* and 13*b*, wherein the respective material part layers 13*a* and 13*b* completely clad the respective contact bases 19*a* and 19*b* laterally. Otherwise, the PTC module 1, in this case, corresponds to the PTC heating module in FIG. 3.

Figure 12:
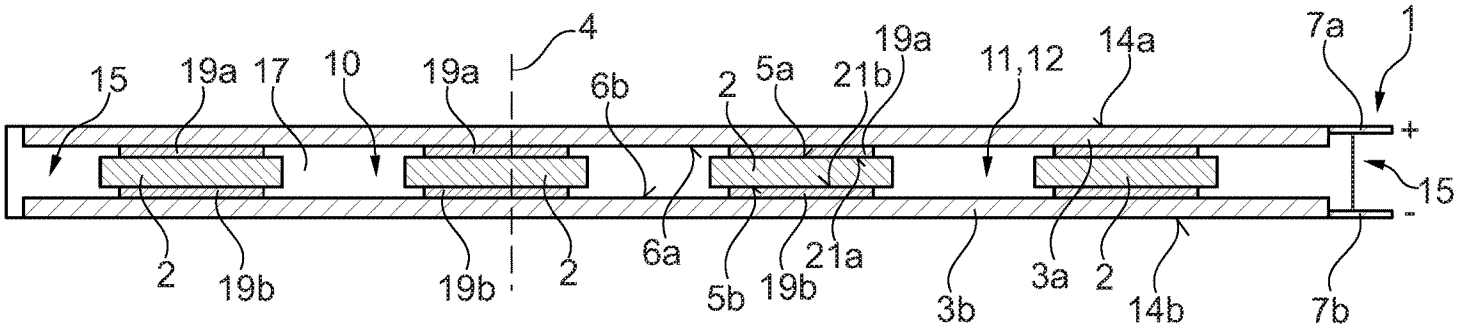

FIG. 12 shows a sectional view of the alternatively configured PTC heating module 1 with the function element 11 in the form of the dielectric coating 12. Here, the respective PTC thermistors 2 are also electrically contacted with the contact plates 3*a* and 3*b* by the contact bases 19*a* and 19*b*. Otherwise the PTC heating module 1, in this case, corresponds to the PTC heating module in FIG. 2.

The dielectric coating 12 in FIGS. 1-6 and FIGS. 8-12 can be applied by injecting or by over-moulding or by spraying-on a dielectric material or by anodizing with a dielectric material or by dipping into a dielectric material or by gluing a film of a dielectric material or by a further suitable method to the contact surface 6*a* and 6*b* of the respective contact plate 3*a* and 3*b*. It goes without saying that the application method should be selected dependent on the desired embodiment of the dielectric coating 12. The dielectric material is preferentially plastic. The basic coating and the insulation cladding are formed from an electrical and preferentially heat-conductive material. The respective contact plates 3*a* and 3*b* and the housing 8 and the rib structure 9 can consist for example of metal. The respective PTC thermistors are produced from a PTC thermistor material. The insulation plate 18 in FIG. 6 can consist for example of ceramic.

In summary, the two potential-carrying contact plates 3*a* and 3*b* in the PTC heating module 1 are physically separated from one another by the function element 11. Because of this, a creepage distance between the two contact plates 3*a* and 3*b* is enlarged and the creepage currents in the PTC heating module 1 excluded. Altogether, the voltage in the PTC heating module 1 and because of this its output can be increased without adjusting the dimensions of the PTC thermistors 2 in the thickness direction 4.

The invention claimed is:

1. A PTC heating module for heating a fluid, comprising:

a plurality of PTC thermistors each having two main surfaces, wherein the two main surfaces of the plurality of PTC thermistors are located opposite to one another and spaced apart relative to one another in a thickness direction, two contact plates each provided with a contact surface, between which the plurality of PTC thermistors are arranged transversely to the thickness direction next to one another and spaced apart relative to one another, wherein the two main surfaces of the plurality of PTC thermistors are electrically contacted with the contact surface of a respective one of the two contact plates, and at least one dielectric function element, arranged between the two contact plates and laterally sealingly engaged about and sealingly adjoins the plurality of PTC thermistors, such that a hollow space between the two contact plates in the thickness direction is at least partly filled out with the at least one dielectric function element and a creepage distance between the two contact plates within the hollow space is enlarged, and wherein the at least one dielectric function element is a dielectric coating, and the hollow space is at least partially filled out with the dielectric coating in the thickness direction.

2. The PTC heating module according to claim 1, further comprising an insulation plate.

3. The PTC heating module according to claim 2, wherein the insulation plate, transversely to the thickness direction, projects out of the hollow space towards an outside such that in an edge region of the two contact plates an air gap between the two contact plates is enlarged.

4. The PTC heating module according to claim 1, wherein the dielectric coating is fixed on each of the contact surfaces of the two contact plates around the plurality of PTC thermistors, and wherein the hollow space between the two contact plates in the thickness direction is partly filled out by the dielectric coating such that an air gap is defined transversely to the thickness direction in the hollow space.

5. The PTC heating module according to claim 1, wherein:

the dielectric coating is fixed on each of the contact surfaces of the two contact plates around the plurality of PTC thermistors, wherein the hollow space between the two contact plates in the thickness direction is partly filled out such that the dielectric coating at least partially covers the plurality of PTC thermistors in the thickness direction, or the dielectric coating is fixed on each of the contact surfaces of the two contact plates around the plurality of PTC thermistors, wherein the hollow space between the two contact plates in the thickness direction is completely filled out, or the dielectric coating is fixed on each of the contact surfaces of the two contact plates around the plurality of PTC thermistors, wherein the hollow space between the two contact plates in the thickness direction is partly filled out and the plurality of PTC thermistors are cladded by the dielectric coating transversely to the thickness direction.

6. The PTC heating module according to claim 1, wherein the dielectric coating laterally dads the at least one contact plate and is disposed outside of the contact surface at least in one region, such that in an edge region of the two contact plates an air gap between the two contact plates is enlarged.

7. The PTC heating module according to claim 4, wherein the dielectric coating completely dads the at least one contact plate around the plurality of PTC thermistors and the two contact plates are electrically insulated towards an outside.

8. The PTC heating module according to claim 1, further comprising:

a dielectric basic coating fixedly bonded on an end face of at least one of the two contact plates, the end face located opposite to the contact surface of the at least one contact plate, wherein the dielectric basic coating electrically insulates the at least one contact plate towards an outside, or a dielectric insulation cladding structured and arranged to clad the two contact plates on a plurality of sides and electrically insulate the two contact plates towards an outside.

9. The PTC heating module according to claim 1, further comprising an electrically conductive contact base arranged between a respective one of the plurality of PTC thermistors and at least one of the two contact plates, the electrically conductive contact base having a support face that is smaller than the two main surfaces of the respective PTC thermistor, and wherein the respective PTC thermistor projects from the electrically conductive contact base transversely to the thickness direction.

10. The PTC heating module according to claim 9, wherein the electrically conductive contact base has a thickness defined in the thickness direction that is smaller than a layer thickness of a dielectric coating of the at least one dielectric function element defined in the thickness direction on at least one of the two contact plates, and wherein the electrically conductive contact base, transversely to the thickness direction, is completely cladded by the dielectric coating on the at least one contact plate.

11. The PTC heating module according to claim 1, further comprising a dielectric basic coating disposed on a respective end face of the two contact plates disposed opposite to the contact surface, wherein the dielectric basic coating electrically insulates the two contact plates towards an outside.

12. The PTC heating module according to claim 1, wherein the dielectric coating, transversely to the thickness direction, projects out of the hollow space towards an outside such that in an edge region of the two contact plates an air gap between the two contact plates is enlarged.

13. The PTC heating module according to claim 2, wherein the insulation plate is composed of ceramic.

14. The PTC heating module according to claim 9, wherein the dielectric coating is disposed on the contact surface of the at least one contact plate, and wherein the electrically conductive contact base has a thickness in the thickness direction that is smaller than a layer thickness of the dielectric coating in the thickness direction.

15. A method for producing a PTC heating module, comprising:

providing a plurality of PTC thermistors each having two main surfaces disposed opposite to one another and spaced apart from one another in a thickness direction of the plurality of PTC thermistors;

arranging the plurality of PTC thermistors between two contact plates next to one another transversely to the thickness direction and spaced apart relative to one another;

joining the plurality of PTC thermistors with the two contact plates, wherein the plurality of PTC thermistors are joined simultaneously with the two contact plates or are joined first with one of the two contact plates and then with the other of the two contact plates, such that the two main faces of the plurality of PTC thermistors are indirectly or directly electrically contacted with a respective contact surface of the two contact plates, and wherein prior to the joining or after the joining of the plurality of PTC thermistors with the two contact plates, applying at least one dielectric function element comprising a dielectric coating onto the respective contact surface of at least one of the two contact plates, wherein applying the at least one dielectric function element comprising the dielectric coating includes at least partially filling a hollow space between the two contact plates in the thickness direction and laterally sealingly engaged about and sealingly adjoins the plurality of PTC thermistors with the dielectric coating.

16. The method according to claim 15, wherein applying the dielectric coating further includes:

applying the dielectric coating on the at least one contact plate in at least one region outside of the respective contact surface such that the at least one contact plate is laterally or completely cladded by the dielectric coating, or applying a dielectric basic coating onto an end face of the at least one contact plate located opposite to the respective contact surface, or applying a dielectric insulation cladding onto the two contact plates to clad the two contact plates on a plurality of sides.

17. The method according to claim 15, wherein the dielectric coating is applied after the joining of the plurality of PTC thermistors with the two contact plates, and wherein applying the dielectric coating includes injecting or over-moulding or spraying-in a dielectric material in the hollow space or by dipping into a dielectric material or by anodizing with a dielectric material.

18. The method according to claim 15, wherein:

the dielectric coating is applied by over-moulding or spraying-on a dielectric material or by dipping into a dielectric material or by anodizing with a dielectric material or by gluing on a film of a dielectric material around the plurality of PTC thermistors after the joining of the plurality of PTC thermistors with a respective one of the two contact plates, or the dielectric coating is applied by over-moulding or by spraying-on a dielectric material or by anodizing with a dielectric material or by dipping into a dielectric material or by gluing-on a film of a dielectric material around a plurality of place holder elements prior to the joining of the plurality of PTC thermistors with the two contact plates, and thereafter removing the plurality of place holder elements and then the plurality of PTC thermistors are placed in positions kept by the plurality of place holder elements and joined with the two contact plates.

19. The method according to claim 15, further comprising arranging an electrically conductive contact base between a respective one of the plurality of PTC thermistors and at least one of the two contact plates, wherein the electrically conductive contact base has a support face that is smaller than a corresponding one of the two main faces of the respective PTC thermistor such that the respective PTC thermistor projects outwardly from the electrically conductive contact base transversely to the thickness direction.

20. A PTC heating module for heating a fluid, comprising:

a plurality of PTC thermistors respectively having two main surfaces disposed opposite to one another and spaced apart relative to one another in a thickness direction;

two contact plates arranged spaced apart from one another in the thickness direction, the plurality of PTC thermistors arranged between the two contact plates next to and spaced apart from one another transversely to the thickness direction, wherein the two main surfaces of the plurality of PTC thermistors are electrically contacted with a respective contact surface of the two contact plates; and a dielectric coating arranged between the two contact plates and laterally sealingly engaged about and sealingly adjoins the plurality of PTC thermistors, wherein the dielectric coating is fixed on the contact surface of at least one of the two contact plates and at least partially fills a hollow space between the two contact plates to facilitate increasing a creepage distance between the two contact plates within the hollow space.

* * * * *